US005839638A

United States Patent [19]

Ronn

[11] Patent Number: 5,839,638

[45] Date of Patent: Nov. 24, 1998

[54] PNEUMATIC TRIM NAILER

[75] Inventor: John C. Ronn, Mount Prospect, Ill.

[73] Assignee: Illinois Tool Works Inc, Glenview, Ill.

[21] Appl. No.: 883,087

[22] Filed: Jun. 26, 1997

[51] Int. Cl.[6] ..... B25C 1/04

[52] U.S. Cl. ..... 227/8; 227/120; 227/142

[58] Field of Search ..... 227/8, 120, 130, 227/142

[56] References Cited

U.S. PATENT DOCUMENTS

| | | | |
|---|---|---|---|
| 3,172,124 | 3/1965 | Kremiller | 227/8 |
| 3,434,643 | 3/1969 | Wandel | 227/130 |
| 3,519,186 | 7/1970 | Volkmann | 227/8 |
| 3,854,648 | 12/1974 | Inzoli et al. | 227/130 |
| 4,053,093 | 10/1977 | Thueringer | 227/130 |
| 4,384,668 | 5/1983 | Tutomu et al. | 227/8 |
| 4,767,043 | 8/1988 | Canlas, Jr. | 227/8 |
| 4,821,937 | 4/1989 | Rafferty | 227/8 |
| 5,261,587 | 11/1993 | Robinson | 227/8 |
| 5,385,286 | 1/1995 | Johnson, Jr. | 227/8 |
| 5,564,614 | 10/1996 | Yang | 227/142 |
| 5,685,473 | 11/1997 | Shkolnikor et al. | 227/8 |
| 5,752,643 | 5/1998 | MacVicar et al. | 227/8 |

OTHER PUBLICATIONS

Paslode®, Mustang Finish Nailer, Model MU–212–F, pp. 1–19, Feb. 1984.

Paslode®, Impulse, Model IM250 F–16 II, pp. 1–4, Apr. 1997.

Paslode®, Finish Nailer, Model 3250 /65–F16, pp. 1–4, Apr. 1997.

Paslode®, Finish Nailer, Model 2138–F18 II, pp. 1–6, Dec. 1996.

Nikema Tool model No. 416–SG schematic. p. 1, no date.

*Primary Examiner*—Stephen F. Gerrity

*Attorney, Agent, or Firm*—Mark W. Croll; Thomas W. Buckman; John P. O'Brien

[57] ABSTRACT

A power fastener driving tool, like a pneumatic trim nailer, of the type for driving fasteners supplied from a collated strip of fasteners disposed in a magazine of the tool. The magazine is coupled to a nose-piece of the fastener driving tool, wherein individual fasteners are sequentially fed into a channel of the nose-piece and driven axially through the nose-piece by a driver blade and into a workpiece. The fastener driving tool includes an improved work contacting element that provides for improved visibility of the nose-piece, an improved depth of drive adjustment for accurately adjusting the work contacting element, an improved hinged nose-piece assembly, and an improved two piece magazine assembly formed of extruded components which provide an accurately dimensioned channel for receiving fastener strips, among other improvements.

20 Claims, 3 Drawing Sheets

PNEUMATIC TRIM NAILER

BACKGROUND OF THE INVENTION

The invention relates generally to power fastener driving tools, and more particularly to pneumatic trim fastener driving tools having an improved work contacting element, depth of drive adjustment, hinged nose-piece assembly, and magazine assembly, among other improvements.

Pneumatically or combustion powered fastener driving tools for driving fasteners into a workpiece are known, and used widely for driving finishing nails, or brads, into wood trim and other materials. The fasteners are supplied from a collated strip of fasteners disposed in a magazine coupled to a nose-piece portion of the fastener driving tool, wherein individual fasteners are sequentially fed into a channel of the nose-piece. A driver blade is accelerated axially through the channel of the nose-piece behind the fastener and into engagement therewith to separate the fastener from the collated strip and to drive the fastener from an aperture of the nose-piece into the workpiece. In many fastener driving tools the magazine is oriented at a right angle relative to the channel in the nose-piece. And in other fastener driving tools the magazine is advantageously swept aftwardly from the nose-piece at an angle relative to the channel therein to improve clearance about the nose-piece and to facilitate handling and operation of the fastener driving tool, particularly while performing nailing operations in narrow spaces, as along corners of intersecting walls and ceilings.

Fastener driving tools include also a work contacting element coupled to a tool controlling mechanism operable as a safety feature to enable and disable the fastener driving tool. The work contacting element is biased forwardly to protrude beyond of an end of the nose-piece, and is movable back and forth over a limited range parallel to the axis of the driver blade and channel. In operation, a tip of the work contacting element is depressed against a surface of the workpiece to move the work contacting element aftwardly relative to the end of the nose-piece to actuate the tool controlling mechanism, thereby enabling the fastener driving tool, wherein the work contacting element is returnable to its forwardly biased position upon removal or release of the work contacting element from the workpiece, which disables fastener driving tool.

The inventor of the present invention recognizes that known prior art work contacting elements have a tendency to interfere with the positioning of the fastener driving tool, often preventing access of the nose-piece to some areas. These prior art work contacting elements tend also to obstruct the operator's view of the nose-piece, thereby preventing accurate location of the fastener in the workpiece. Accurate location of fasteners in the workpiece is particularly desirable in finishing trim operations. U.S. Pat. No. 5,564,614 entitled "Nailing Depth Adjusting Mechanism for Pneumatic Nail Guns" issued 15 Oct., 1996 to Yang is exemplary of many known prior art work contacting elements formed of a partially looped wire member disposed forwardly and about the nose-piece, but which suffer the disadvantages discussed above. These prior art work contacting elements generally have a large profile, or large contact surface area, to prevent gouging or marring of the workpiece, especially the softer wood varieties. Thus, at least for trim fastener driving tools, there appears to have been a reluctance to decrease the profile of the work contacting element because, it was thought, to do so may damage the workpiece. But the relatively large profile of existing work contacting elements only exacerbates the tendency of the work contacting element to interfere with the operation of the fastener driving tool, and moreover unnecessarily increases the weight of the fastener driving tool.

Another known and desirable feature of fastener driving tools is the adjustability of the depth of penetration, or drive, of the fastener into the workpiece. The depth of drive adjustment is performed generally by adjusting the extent to which the work contacting element protrudes forwardly beyond the tip of the nose-piece, thereby adjusting the extent to which the driver blade extends toward the workpiece and the extent to which the fastener is driven into the workpiece. A head portion of the fastener may thus be either countersunk below the workpiece surface, or be flush with the workpiece surface, or stand proud from the workpiece surface.

The inventor of the present invention recognizes, however, that known prior art depth of drive adjustment mechanisms are generally complex assemblies having many cooperating elements that very often do not maintain a set depth adjustment, particularly during prolonged operation of the fastener driving tool. In U.S. Pat. No. 5,564,614 entitled "Nailing Depth Adjusting Mechanism for Pneumatic Nail Guns" issued 15 Oct., 1996 to Yang, for example, an end portion of the partially looped wire work contacting element is threadedly coupled to a firing control strip actuatable to enable and disable the fastener driving tool. More particularly, the threaded portion of the work contacting element is disposed through first and second axially aligned holes formed in corresponding first and second parallely spaced lugs, or flanges, of the firing control strip. A toothed adjusting wheel, or nut, is rotatably disposed about the threaded potion of the work contacting element, between the parallel flanges of the firing control strip, and a compressed spring is disposed between the forwardmost flange and a recessed end of the adjusting wheel apparently to prevent unintentional rotation of the adjusting wheel, and allegedly to absorb shock. An end portion of the threaded portion of the work contacting element is disposed in a socket, or flanged sleeve, disposed through the second hole in the aftmost flange allegedly to allow smooth adjustable movement of the work contacting element relative to the flanges of the firing control strip. And an end cap on the flanged sleeve apparently limits adjustment of the work contacting element toward the tip of the nose-piece. The depth of drive adjustment in U.S. Pat. No. 5,564,614 thus has many cooperating components which require extensive fabrication including forming the flanges and drilling the holes therein, and is laborious to assembly, thus increasing costs. Additionally, the efficacy of the compressed spring for the purpose of preventing unintentional depth adjustment of the work contacting element is questionable unless the spring is extremely stiff, but such a stiff spring significantly complicates the assembly thereof in the narrow space between the parallel flanges.

Yet another known and desirable feature of fastener driving tools is the ability to gain access to the channel of the nose-piece for the purpose of relieving or extricating fasteners jammed therein, which occurs occasionally. The Paslode®, Model IM250 F-16 Cordless Finish Nailer, for example, includes a nose-piece composed of two hingedly connected components retained together in a closed configuration by a Quick Clear lever having a C-shaped recess on a back end thereof, located away from an end of the nose-piece. The lever is movable forwardly toward the end of the nose-piece against the bias of a stretched spring to release the nose-piece components from the grasp of the C-shaped recess. But fasteners jammed in the channel formed between the hinged nose-piece components tend to force the components apart, thereby binding the lever, which prevents movement of the lever toward the end of the nose-piece as is necessary to open the nose-piece and gain access to the channel therein. Actuation of the lever is further complicated by the inconvenient location of a gripping member thereon toward a relatively inaccessible portion of the tool. In practice, users often apply an impact force to the lever to release the nose-piece components, but this is undesirable because it may damage the fastener driving tool. Also, the lever of the IM250 F-16 has a tendency to pivot because the travel of the lever is not constrained along the longitudinal direction of the nose-piece, thereby requiring the operator to conscientiously direct the movement of the lever along the longitudinal direction of the nosepiece, which further complicates actuation of the lever, particularly when a fastener is jammed in the nose-piece. Finally, the lever must be manually actuated to permit closing of the pivoting portion of the nose-piece and to engage the nose-piece components in the C-shaped recess of the lever.

The magazine of powered fastener driving tools also includes generally a channel formed between opposing side walls of the magazine for receiving the collated strip of fasteners. The spacing between the opposing side walls is a critical dimension. If the spacing is too wide, ends of adjacent collated strips of fasteners have a tendency to overlap and jam in the magazine channel. If the spacing is too narrow, the collated strip of fasteners may become bound therein. This is particularly true in view of the fact that the collated strip of fasteners is not necessarily perfectly flat. The inventor of the present invention recognizes that known prior art magazines suffer from many drawbacks resulting from necessity of accurately spacing the side walls forming the magazine channel. Single piece, or unitary, magazines for example are formed generally by an extrusion process, wherein the channel, or hollow passage, along the longitudinal axis of the magazine has a donut-like cross-sectional shape. By this process, however, accurate formation of the channel dimensions, particularly the channel width, along the entire length of extruded unitary magazine is not possible. Known extruded unitary magazines therefore must generally be subject to a subsequent sizing operation to compensate for variations in the channel dimension. But the sizing operation is time consuming and costly. Other magazines are formed of two extruded halves which are subsequently assembled and appropriately spaced by spacer members in cooperation with corresponding transverse screws, which retain the halves in an assembly. The extruded magazine halves exhibit improved channel spacing consistency in comparison to unitary magazines, but the two-piece magazines require additional fabrication including drilling and tapping transverse holes therethrough, require additional components, and require subsequent assembly, which increase costs.

The present invention is drawn to advancements in fastener driving tools generally, including improvements in pneumatic trim fastener driving tools, which overcome problems in the prior art.

It is thus an object of the present invention to provide a novel fastener driving tool having novel work contacting elements, novel depth of drive adjustments, novel hinged nose-piece assemblies, and novel magazine assemblies, among other improvements, and combinations thereof.

It is another object of the invention to provide a novel fastener driving tool having a nose-piece with a channel for guiding a fastener driven therefrom into a workpiece, a work contacting element having a tip is biased to protrude forwardly beyond an end of the nose-piece, and the work contacting element is slidable back and forth along an underside of the nose-piece parallel to the channel thereof to actuate and de-actuate a tool controlling mechanism upon depressing the tip against the workpiece, whereby the work contacting element has a low profile for improved visibility of the nose-piece and for improved operation and handling of the tool without damaging the workpiece.

It is another object of the invention to provide a novel fastener driving tool having a work contacting element slidably coupled to a nose-piece to actuate a tool controlling mechanism, the work contacting element is biased to protrude forwardly beyond an end of the nose-piece, a link having a threaded portion is coupled to the work contacting element along one side of the nose-piece, a bracket having two spaced apart fingers with corresponding curved end portions is arranged on opposing sides of the link, which is disposed across the fingers, and an adjustment nut and a compressed ring are disposed about the threaded portion of the link between the fingers of the bracket, whereby the work contacting element is adjustable relative to the nose-piece upon rotation of the adjustment nut, and the compressed resilient ring prevents unintentional adjustment thereof.

It is a still a further object of the invention to provide a novel fastener driving tool having a nose-piece formed by a backplate hingedly coupled to a frontplate, the backplate pivotable relative to the frontplate between an opened configuration and a closed configuration, wherein the nose-piece defines a channel therebetween for driving a fastener from an end of the nose-piece into a workpiece when the nose-piece is in the closed configuration, and exposing the channel when the nose-piece is in the opened configuration. Corresponding flanges protruding from a side of the backplate and the frontplate are receivable in a recess of a lever when the nose-piece is in the closed configuration, wherein the lever is biased toward the end of the nose-piece to maintain the nose-piece in the closed configuration, and the lever is movable away from the end of the nose-piece against the bias to release the first flange and the second flange from the recess of the lever, whereby the backplate is pivotable relative to frontplate to the opened configuration when the first flange and the second flange are released from the recess of the lever.

It is yet another object of the invention to provide a novel fastener driving tool having a nose-piece with a channel for sequentially receiving individual fasteners from a collated strip of fasteners disposed in a channel of a magazine formed by mating first and second elongated members having corresponding side walls formable individually by extrusion, the first and second elongated members biased away from each other by a tapered member disposed in an opening at opposing ends of the magazine, the opening defined by mating portions of the elongated members and extending along the entire length of the magazine, whereby the tapered members accurately space apart the side walls to form the magazine channel therebetween.

These and other objects, features and advantages of the present invention will become more fully apparent upon careful consideration of the following Detailed Description of the Invention and the accompanying Drawings, which may be disproportionate for ease of understanding, wherein like structure and steps are referenced by corresponding numerals and indicators.

DETAILED DESCRIPTION OF THE INVENTION

Figure 1:
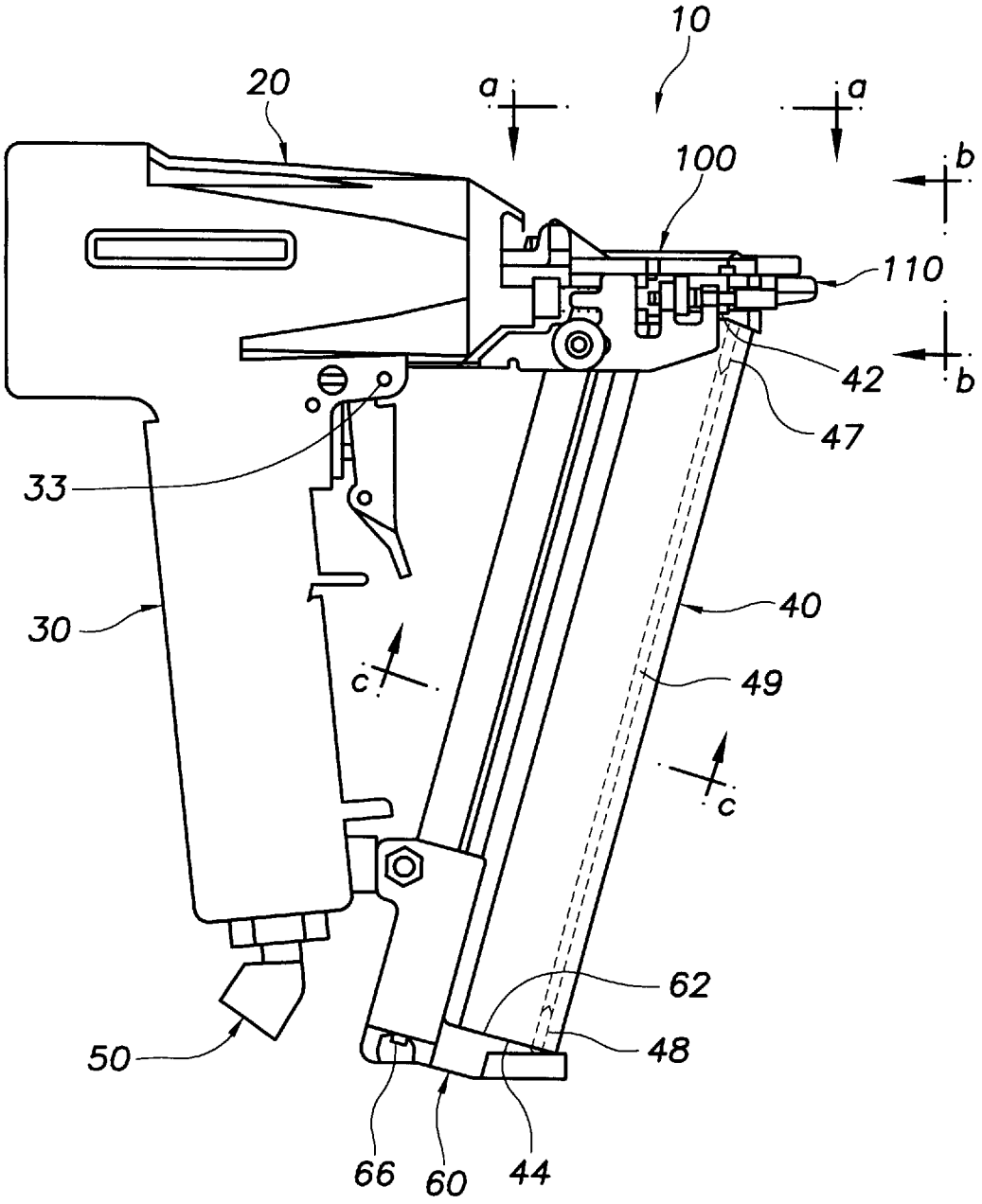
FIG. 1 is a side plan view of a pneumatic fastener driving tool according an exemplary embodiment of the invention.
Figure 3:
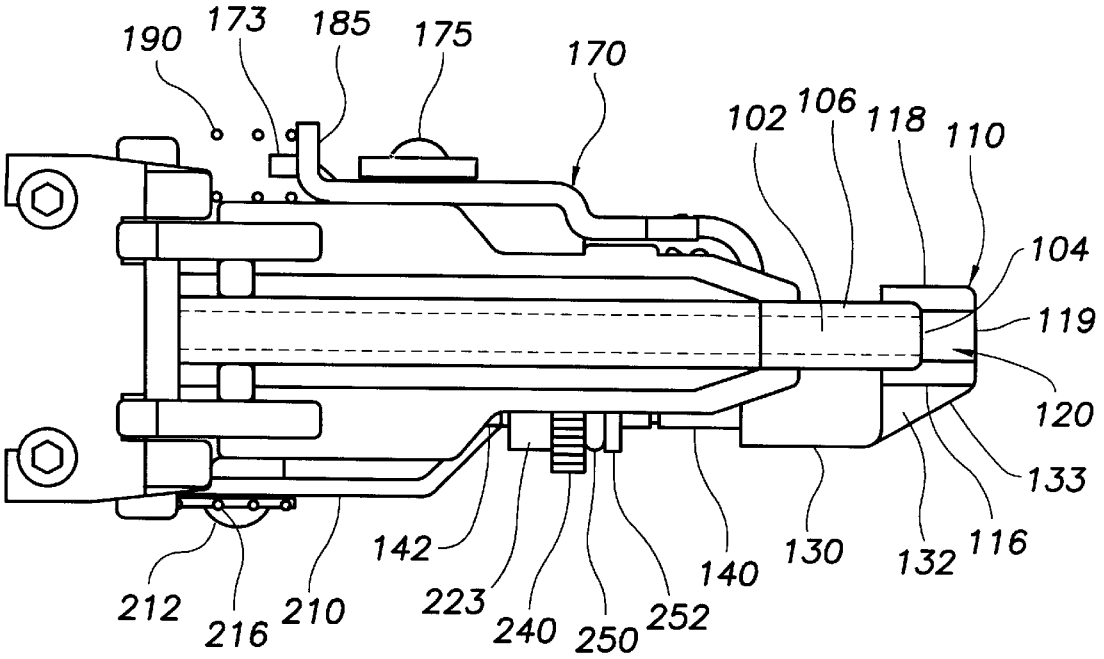
FIG. 3 is a partially enlarged top plan view of the nose-piece portion along lines a—a of FIG. 1.
Figure 5:
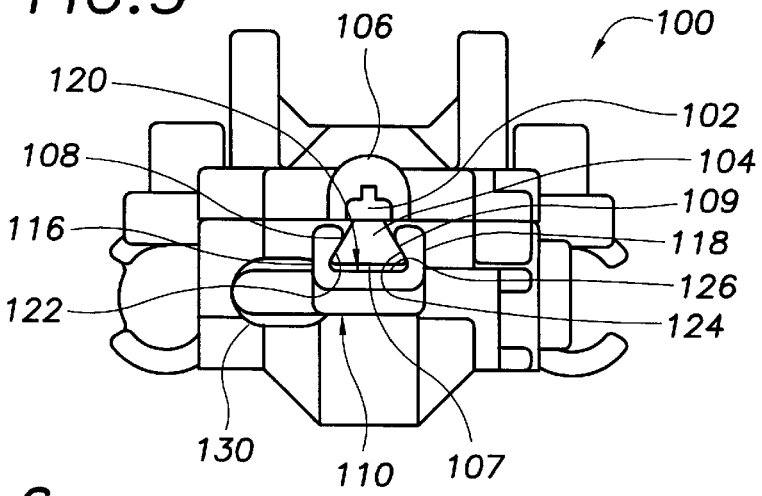
FIG. 5 is a partially enlarged front end elevational view of the nose-piece portion along lines b—b of FIG. 1.

FIG. 1 is a side plan view of a powered fastener driving tool 10 useable for driving fasteners or brads arranged in an obliquely collated strip, comprising generally a housing portion 20 coupled to a nose-piece 100, a handle 30 extending from the housing 20, and a magazine 40 coupled to the nose-piece 100, wherein the magazine 40 extends aftwardly away from the nose-piece 100 at an angle toward the handle 30 as shown in the exemplary embodiment. Alternatively, the magazine may extend from the nose-piece 100 at a right angle thereto. The exemplary embodiment of FIG. 1 also shows a pneumatic supply coupling 50 at a base of the handle 40. FIGS. 3 and 5 show the nose-piece 100 having a channel 102 therein for receiving individual fasteners from the collated strip of fasteners and for guiding fasteners driven from an aperture of the nose-piece 100 toward a target material, as is known in the art. Although the exemplary fastener driving tool has an angled magazine, the objects, features, aspects and advantages of the invention are applicable to magazines oriented at right angles to the nose-piece 100, and to fastener driving tools useable for driving finishing brads, whether powered pneumatically or by combustion means or otherwise.

Figure 2:
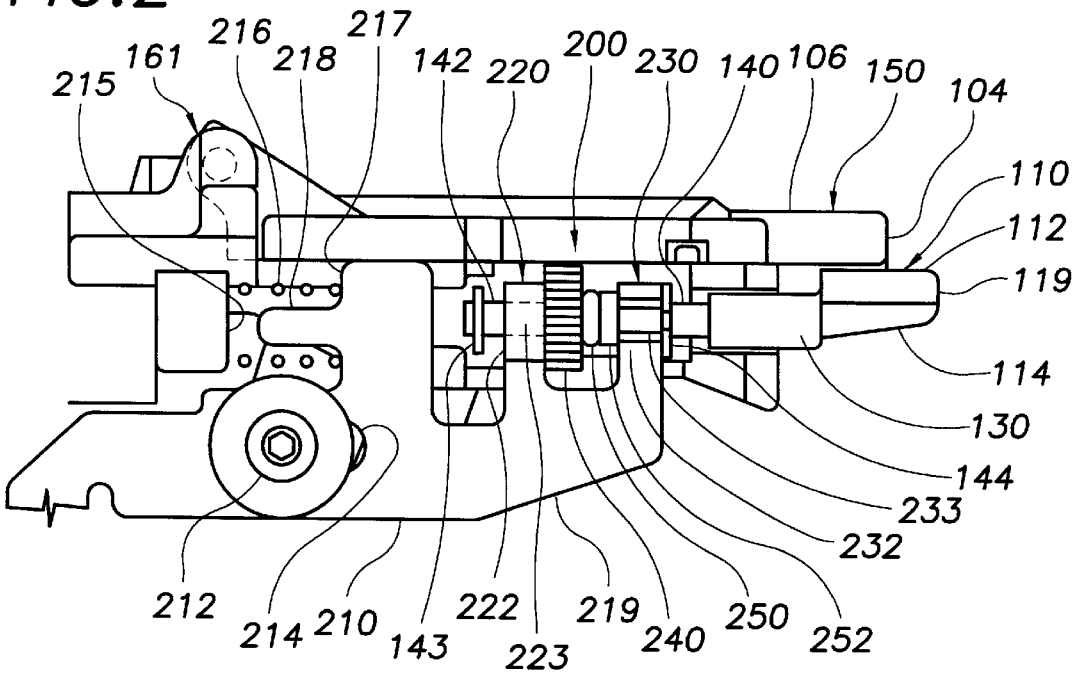
FIG. 2 is a partially enlarged first side elevational view of a nose-piece portion of the tool of FIG. 1.

The fastener driving tool 10 also includes a work contacting element 110 coupled to a tool controlling mechanism for actuating the tool controlling mechanism, which enables and disables the fastener driving tool as known generally in the art. According to one aspect of the invention shown in FIGS. 2–5, the nose-piece 100 also includes an end 104, a top side 106, an underside 107, and opposing sides 108 and 109. The work contacting element 110 includes a top side 112, a bottom side 114, substantially opposing sides 116 and 118, and a tip 119. FIGS. 2 and 3 show the work contacting element 110 also including a recess 120 formed in the top side 112. Portions of the underside 107 of the nose-piece 100 and portions of the opposing sides 108 and 109 of the nose-piece 100 are disposed in the recess 120 of the work contacting element 110 to slidably retain the work contacting element 110 to the nose-piece 100. The tip 119 of the work contacting element 110 is biased to protrude forwardly beyond the end 104 of the nose-piece 100, as discussed further below. The work contacting element 110 is slidable back and forth along the underside 107 of the nose-piece 100, parallel to the channel 102 of the nose-piece 100, to actuate and deactuate the tool controlling mechanism, which enables and disables the tool 10.

Figure 4:
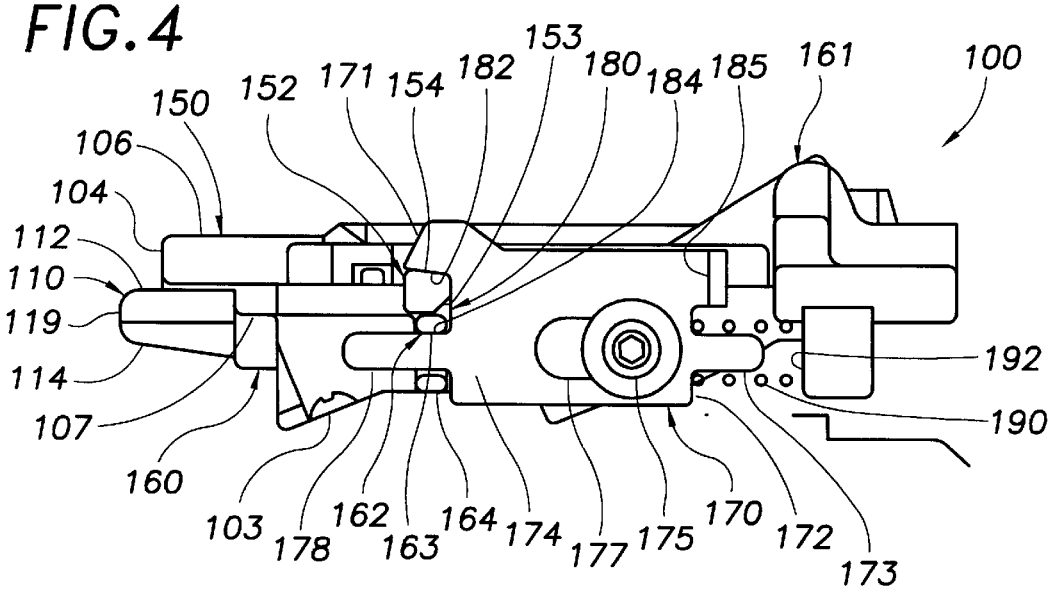
FIG. 4 is a partially enlarged second opposing side elevational view of the nose-piece portion of FIG. 1.

The location of the work contacting element 110 below and along the underside 107 of the nose-piece 100 significantly improves visibility of the nose-piece 100, particularly the end 104 thereof, by the operator of the fastener driving tool 10, thereby permitting more accurate positioning of fasteners driven into the workpiece, which is highly desirable in trim finishing operations. FIGS. 2–4 show the work contacting element 110 having a low profile resulting from its relatively narrow width and tapered surfaces, including the bottom side 114 thereof, and also resulting from the proximity and partially wrapped around relationship of the work contacting element 110 to the nose-piece 100. The low profile of the work contacting element 110 further increases visibility of the nose-piece 100 by the operator, and improves clearance about the nose-piece 100, thereby facilitating handling and operating the fastener driving tool 10, which is desirable while performing nailing operations in some spaces, such as along corners of intersecting walls and ceilings.

FIG. 5 shows the nose-piece 100 having opposing sides 108 and 109 extending divergently from the top-side 106 of the nose-piece toward the underside 107 of the nose-piece 100 to form a substantially dove-tailed sectional shape. The recess 120 in the work contacting element 110 has a complementary substantially dove-tailed sectional shape formed by divergently extending side walls 122 and 124 and by a bottom surface 126. The divergently extending side walls 122 and 124 of the recess 120 are slidably matable with the divergently extending side walls 108 and 109 of the nose-piece 100, and the bottom surface 126 of the recess 120 is slidingly matable with the underside 107 of the nose-piece 100, thereby slidingly retaining the work contacting element 110 to the nose-piece 100. The nose-piece 100 may have other sectional shapes, including square, rectangular and curved shapes so long as the recess of the work contacting element 110 has a partially complementary shaped sectional surface that is slidingly retainable to the nose-piece 100. According to this aspect of the invention, the work contacting element 110 is slidable relative to the nose-piece 100, back and forth in a direction parallel to the channel 102 in the nose-piece 100.

FIGS. 2, 3 and 5 show the work contacting element 110 including an arm 130 extending rearwardly away from the tip 119 of the work contacting element 110 and along one side of the nose-piece 100. FIG. 3 shows the arm 130 offset to one side of the work contacting element 110 and partially interconnected thereto by a flange 132 having a tapered side 133 to maintain the low profile of the work contacting element 110, and to eliminate any protrusions that may interfere with operation of the fastener driving tool 10. FIGS. 2 and 3 show the work contacting element 110 also having a wire link 140 with a threaded end portion 142 protruding from the arm 130 of the work contacting element 110 and extending generally aftwardly away from the end 104 of the nose-piece 100. In the exemplary embodiment, the work contacting element 110 including the arm 120 and the flange 132 are formed unitarily of a plastic material, including urethane, polyurethane and glass filled nylon materials. In one preferred embodiment, the wire link 140 is captured in the arm 130 of the unitarily formed plastic portion of the work contacting element, for example in an insert molding operation. In addition to the advantages discussed above, formation of the work contacting element 110 and particularly the tip 119 thereof from a plastic reduces the tendency of the tip 119 to damage the workpiece, in comparison to prior art work contacting elements formed from metals. A softer, resilient plastic is especially suitable for this purpose, so long as the work contact element 110 is sufficiently rigid to actuate the tool controlling mechanism.

The fastener driving tool 10 also includes a depth of drive adjustment mechanism 200 for adjusting the extent to which the tip 119 of the work contacting element 110 protrudes beyond the end 104 of the nose-piece 100. FIGS. 2 and 3 show a bracket 210 coupled to the tool controlling mechanism and movably coupled to the fastener driving tool 10, wherein the bracket 210 is generally slidable relative to the nose-piece 100 toward and away from the end 104 of the nose-piece 100. In the exemplary embodiment, the bracket 210 is coupled partially to the fastener driving tool 10 by a bolt 212 extending through an elongated slot 214 in the bracket, permitting movement of the bracket 210 relative to the bolt 212 toward and away from the end 104 of the nose-piece 100, generally parallel to the channel 102 in the nose-piece 100. FIG. 1 shows the bracket 210 extending aftwardly away from the nose-piece 150 and translatably supported between the body 20 and a roll pin 33, thereby preventing pivoting of the bracket 210 about the bolt 212. A compressed spring member 216 is disposed between an end 217 of the bracket 210 and a portion 215 of the fastener driving tool 10 to bias the bracket 210 forwardly toward the end 104 of the nose-piece 100. The compressed spring member 216 is also partially disposed about a protruding member 218 extending rearwardly from the bracket 210 to retain the compressed spring member 216 in cooperative engagement with the bracket 210.

A front end portion 219 of the bracket 210 includes two spaced apart fingers 220 and 230, wherein each finger has a substantially C-shaped curved end portion 222 and 232 forming a corresponding groove 223 and 233 across the corresponding finger, wherein the grooves 223 and 233 across the fingers are formed along a common axis, which corresponds with an axis of the link 140. According to this aspect of the invention, a portion of the link 140 is disposed in the grooves 223 and 233 of the fingers 220 and 230, wherein the C-shaped curved end portions 223 and 232 of the fingers 220 and 230 are arranged on opposing sides of the portion of the link 140 disposed in the grooves 223 and 233 of the fingers. Also, the fingers 220 and 230 have a relatively increased width or dimension along the axis of the link 140, which tends to reduce friction between the link 140 and the fingers 220 and 230, thereby facilitating more smooth axial adjustment of the work contacting element 110.

An adjustment nut 240 is disposed about the threaded portion 142 of the link 140 between the fingers 220 and 230 of the bracket 210, and a resilient ring 250 is also disposed about the threaded portion 142 of the link 140, wherein the resilient ring 250 is disposed between the adjustment nut 240 and one of the fingers 220 or 230 under compression. The resilient ring 250 may be an o-ring or a rubber or plastic washer member, having resilient characteristics. The link 140 of the work contacting element 110 is thus coupled to the bracket 210 of the tool controlling mechanism, whereby the work contacting element 110 is adjustable toward and away from the end 104 of the nose-piece 100 upon rotation of the adjustment nut 240, which may include a knurled outer surface to facilitate rotation thereof. The compressed resilient ring member 250 prevents unintentional rotation of the adjustment nut 240, and adjustment of the work contacting element 110, which may occur during operation and handling of the fastener driving tool 10.

The C-shaped curved end portions 222 and 232 of the fingers 220 and 230 may be curved more or less, and in some configurations the C-shaped curved end portions may be curved to form a partially or completely closed annular portion, wherein the grooves 223 and 233 are completely surrounded or nearly so to form corresponding passages therethrough for receiving the link 140. The increasing extent to which the C-shaped end portions 222 and 232 are curved correspondingly increases surface area contact with the adjustment nut 240 and the compressed resilient ring 250 disposes between the fingers 220 and 230, thereby increasing friction therebetween and hence decreasing the likelihood of unintentional adjustment of the work contacting element 110. Notably, formation of the C-shaped curved end portions 222 and 232 of the fingers in a press forming or stamping operation is substantially less costly than forming holes by drilling or milling operations as in the prior art, regardless of the extent to which the C-shaped curved end portions are curved. In applications where the C-shaped curved end portions 222 and 232 of the fingers 220 and 230 are completely or nearly completely closed, the fingers 220 and 230 may be disposed along the same side of the link 140. And in embodiments having only minimally and partially curved C-shaped end portions 222 and 232 on the fingers 220 and 230, a washer 252 may be disposed about the threaded portion 142 of the link 140, between the resilient ring 250 and the finger 230. According to this configuration, the washer 252 provides a closed annular surface against which the compressed resilient ring member 250 is seated, thereby providing increasing surface contact area with the compressed resilient ring member 250, which increases the friction caused by the compressed ring member 250 as discussed above.

According to another aspect of the invention shown in FIG. 2, a first adjustment limiting member 144 is disposed about the link 140 and fixed along the axial dimension thereof between the work contacting element 110 and the finger 230 of the bracket 210, whereby the first adjustment limiting member 144 limits adjustment of the work contacting element 110 toward the end 104 of the nose-piece 100. A second adjusting member 143 may be disposed about the link 140 on the threaded end portion 142 thereof behind the finger 220 away from the tip of the nose-piece 150, whereby the second adjustment limiting member 143 limits adjustment of the work contacting element 110 away from the end 104 of the nose-piece 100, thereby preventing separation of the work contacting element 110 from the tool 10. The adjustment limiting members 143 and 144 may, for example, be an E-ring resiliently disposed about corresponding grooves formed in the link 140. The second adjustment limiting member 143 may alternatively be an end cap frictionally disposed about the threaded portion 142 of the link 140. And in some applications, the first adjustment limiting member 144 may be eliminated, whereby adjustment of the work contacting element 110 toward the end 104 of the nose-piece 100 is limited by the discontinuation of the threaded portion 142 about which the adjustment nut 240 advances the link 140.

The depth of drive adjustment mechanism 200 of the present invention is thus a relatively simple assembly having a minimum number of components, which provide accurate and reliable adjustment of the work contacting element 110 relative to the end 104 of the nose-piece 100. The compressed resilient ring member 250 of the depth of drive adjustment mechanism 200 of the present invention prevents slippage or unintentional rotation of the adjustment nut 240 during operation and handling of the fastener driving tool 10, which is an improvement over prior art mechanisms. Also, the C-shaped curved edges 222 and 232 of the fingers 220 and 230 are formable in a stamping operation simultaneously with the cutting of the bracket member 210 from sheet metal, thereby eliminating the necessity of subsequent drilling operations to form link receiving holes as required in the prior art. Since the work contacting element 110 is supportably coupled to the nose-piece 100 and is slidable relative thereto toward and away from the end 104 of the nose-piece 100, the C-shaped curved edges 222 and 232 of the first and second fingers 220 and 230 do not support the work contacting element 110 as in the prior art, but instead provide a means for adjustably coupling the work contacting element 110 to the bracket 210 of the tool controlling mechanism for the purpose of transferring axial movement of the work contacting element 110 along the axis of the link 140 to the bracket 210.

FIGS. 2–5 show the nose-piece 100 having a backplate 150 hingedly coupled to a frontplate 160, wherein the backplate 150 is pivotable about a hinged end 161 relative to the frontplate 160 between a closed configuration and an opened configuration. FIG. 5 shows the backplate 150 and frontplate 160 defining the channel 102 therebetween for guiding a fastener from the nose-piece 100 into a workpiece when the backplate 150 and the frontplate 160 are in the closed configuration, wherein the channel 102 is exposed when the backplate 150 and the frontplate 160 are in the opened configuration.

According to another aspect of the invention shown best in FIG. 4, a first flange 152 protrudes from a side of the backplate 150 substantially transverse to the channel 102, and a second flange 162 protrudes from the same side of the frontplate 160 substantially transverse to the channel 102. The first flange 152 and the second flange 162 are adjacent and in substantially mating relationship when the backplate 150 and the frontplate 160 are in the closed configuration. A lever 170 is also disposed along the side of the nose-piece 100, wherein the lever 170 is movable back and forth relative to the nose-piece 100, substantially parallel to the axis of the channel 102. The lever 170 has a back end 172 and an opposing front end 174 disposed toward the end 104 of the nose-piece 100, the front end 174 having a recess 180 for receiving the first flange 152 and the second flange 162, which are in substantially mating relationship when the backplate 150 and the frontplate 160 are in the closed configuration.

The lever 170 is movably coupled to the nose-piece 100 by a bolt 175 disposed through an elongated slot 177 through the lever 170. A compressed spring member 190 is disposed between the back end 172 of the lever 170 and a portion 192 of the nose-piece 100 to bias the lever 170 forwardly toward the end 104 of the nose-piece 100, wherein the compressed spring member 190 is also partially disposed about a protruding member 173 extending rearwardly from the lever 170 to retain the compressed spring member 190 in cooperative engagement with the lever 170. The lever 170 also includes a front protruding member 178 extending forwardly from the front end 174 thereof, wherein the front finger 178 is disposed between opposing guide members 162 and 164 on the nose-piece 100, wherein the guide member 162 is also the second flange. The opposing guide members 162 and 164 guide movement of the lever 170 substantially parallel to the channel 102 of the nose-piece 100.

In operation, the first flange 152 and the second flange 162 are both receivable in the recess 180 of the lever 170 and are maintained in substantially mating relationship when the backplate 150 and the frontplate 160 are in the closed configuration. According to this aspect of the invention, an upper surface 182 of the recess 180 is engageable with an upper surface 154 of the first flange 152, and a lower surface 184 of the recess 180 is engageable with a lower surface 163 of the second flange 162 to prevent pivotal movement of the backplate 150 relative to the frontplate 160. The lever 170 is however movable rearwardly away from the end 104 of the nose-piece 100 against the bias of the compressed spring member 190 to release the first flange 152 and the second flange 162 from the recess 180 of the lever 170, whereby the backplate 150 is pivotable upwardly relative to the frontplate 160 and away therefrom to the opened configuration when the first flange 152 and the second flange 162 are released from the recess 180 of the lever 170. FIGS. 3 and 4 show the lever 170 including a flange 185 protruding laterally outwardly away from the lever 170 to facilitate manual gripping of the lever 170 and moving the lever 170 rearwardly away from the end 104 of the nose-piece 100 against the bias of the compressed spring, member 190.

FIG. 4 shows the first flange 152 on the backplate 150 having an inclined lower rearwardly located surface 153, and the lever 170 having a bevelled upper forwardly located surface 171, wherein the inclined surface 153 of the backplate 150 is engageable with the inclined surface 171 of the lever 170 when the backplate 150 is moved from the opened configuration to the closed configuration, thereby moving the lever 170 rearwardly away from the end 104 of the nose-piece 100 against the bias of the compressed spring 190. According to this aspect of the invention, the backplate 150 is movable from the opened configuration to the closed configuration without manually gripping the lever 170 and moving the lever aftwardly away from the end 104 of the nose-piece 100.

FIG. 1 shows the magazine 40 having a front end 42 coupled to the nose-piece 100 for sequentially feeding individual fasteners from a channel of the magazine 40 to the channel 102 of the nose-piece 100. FIG. 1 also shows the magazine 40 having a back end 44 coupled to an end cap 60. The end cap 60 has a surface 62 matable with the back end 44 of the magazine 40 and secured thereto by fastener members 66, like bolts or screws, extending through the end plate 60 and into the back end 44 of the magazine 40, as discussed further below. FIG. 3 shows the nose-piece 100 having a surface 103 matable with the front end 42 of the magazine 40 and secured thereto by fastener members extending through the nose-piece 100 and into the front end 42 of the magazine 40, as discussed further below.

Figure 6:
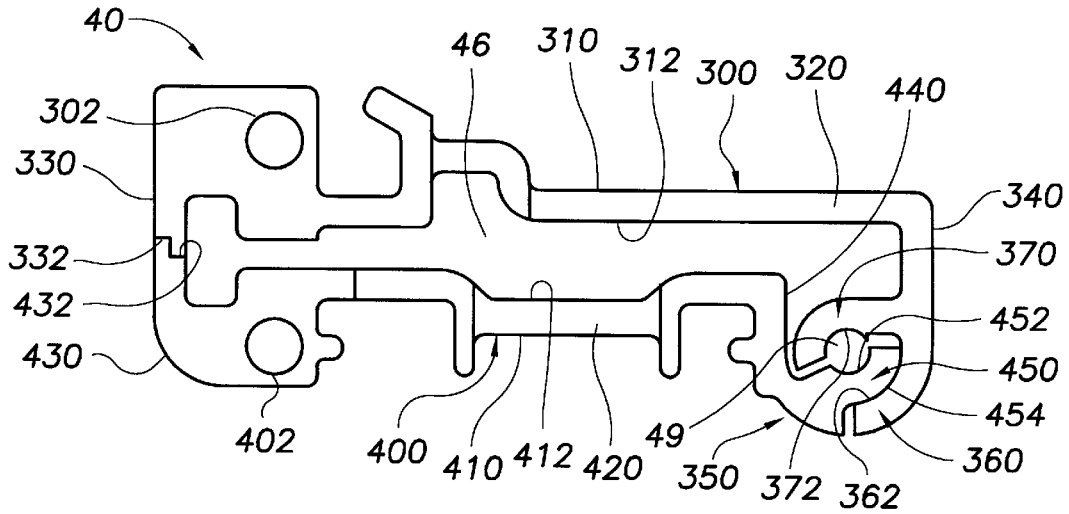
FIG. 6 is a sectional view of a fastener driving tool magazine portion along lines c—c of FIG. 1.

FIG. 6 is a sectional view of the magazine 40 showing the channel 42 for receiving the collated strip of fasteners, wherein the channel 42 of the magazine 40 has a substantially T-shaped cross-section for receiving a head portion and pointed shank of the collated strip of brads, or fasteners. FIG. 6 also shows the magazine 40 formed of a first elongated member 300 with a first side wall 310 having a first inner surface 312, a first front end and a first opposing rear end both having the same configuration denoted by 320 in FIG. 6, a first top edge portion 330 having a first mating edge 332, and a first bottom edge portion 340. The magazine is also formed of a second elongated member 400 matably coupled to the first elongated member 300, wherein the second elongated member 400 has a second side wall 410 having a second inner surface 412, a second front end and a second rear end both having the configuration denoted by 420 in FIG. 6, a second top edge portion 430 having a second mating edge 432, and a second bottom edge portion 440.

The first bottom edge portion 340 of the first elongated member 300 includes a recess 350 formed by an outer flange 360 and an inner flange 370, wherein the recess 350 extends along the entire length of the first elongated member 300 between the front end 42 and the rear end 44, shown in FIG. 1. The second bottom edge portion 440 of the second elongated member 400 includes an intermediate flange 450 with an inner surface 452 and an outer surface 454. When assembled, the first mating surface 332 of the first elongated member 300 is matable with the second mating surface 432 of the second elongated member 400. In the exemplary embodiment, the first and second mating surfaces 332 and 432 have complementary stepped configurations to positively align the first and second elongated members 300 and 400 in mating relationship. Also, the intermediate flange 450 of the second elongated member 400 is disposeable in the recess 350 formed by the inner flange 370 and the outer flange 360 of the first elongated member 300, so that the first inner surface 312 of the first side wall 310 faces the second inner surface 412 of the second side wall 410.

FIG. 1 shows first and second tapered members 47 and 48 disposed in an opening 49 between the inner surface 452 of the intermediate flange 450 and the inner flange 370 at the front end 42 and the rear end 44 of the magazine to urge the outer surface 454 of the intermediate flange 450 into engagement with the outer flange 360 along the entire length of the magazine, shown also in FIG. 6, thereby accurately spacing the first inner surface 312 of the first side wall 310 relative to the second inner surface 412 of the second side wall 410 to form the channel 46 therebetween in the magazine 40. According to this aspect of the invention, the cooperative engagement between the outer surface 454 of the intermediate flange 450 and the outer flange 360 is along the entire length of the magazine between the front end 42 and the rear end 44, thereby substantially eliminating the tendency of the dimension of the magazine channel 46 to vary along the length of the magazine as a result of warping of the side walls 310 and 410 intermediate transversely disposed spacer members commonly used in prior art two-piece magazine assemblies.

FIG. 6 shows a portion of the recess 350 formed on an inner surface 362 of the outer flange 360 having a curved surface, and the outer surface 454 of the intermediate flange 450 having a complementary curved surface matably engageable with the curved inner surface 362 of the outer flange 360 as the intermediate flange 450 is urged outwardly by the tapered members 47 and 48. FIG. 6 also shows a portion of the recess 360 formed on an inner surface 372 of the inner flange 370 having a curved surface, and the inner surface 452 of the intermediate flange 450 having a curved surface, wherein the curved surface 372 of the inner flange 370 faces the curved surface 452 of the intermediate flange 450 to form the opening 49 therebetween, which extends the entire length of the magazine.

As discussed above, the tapered members 47 and 48 are disposable into the opening 49 of the magazine 40. FIG. 1 shows the rear end plate 60 disposed on the rear end 44 of the magazine 40 formed by the first rear ends of the first and second elongated members 300 and 400. Two fasteners 66, only one of which is shown in FIG. 1, are disposed through the end plate 60 and into corresponding openings 302 and 402 of the magazine 40, shown in FIG. 6, from the rear end 44 of the first and second elongated members 300 and 400, thereby further coupling the end plate 60 to the magazine 40. Two fasteners members, not shown, also protrude from the nosepiece 100 and into the openings 302 and 402 from the front end 42 of the magazine 40, thereby coupling the nose-piece 100 to the magazine.

FIG. 6 also shows the first elongated member 300 having the same cross-sectional configuration along the entire length of thereof, and the second elongated member 400 having the same cross-sectional configuration along the entire length thereof. According to this aspect of the invention, the first elongated member 300 and the second elongated member 400 are formable by extrusion processes. Extruding the elongated members 300 and 400 individually significantly increases the dimensional precision with which the elongated members 300 and 400 may be formed. Additionally, opening 49 defined by the curved surfaces 372 and 452 is formed during the extrusion process, and thus does not require subsequent drilling or milling steps as is required in the manufacture of prior art two-piece magazines. The opening 302 and 402 are similarly formable during the extrusion process and extend along the entire length of the magazine, thereby providing access from the front and rear ends 42 and 44 of the magazine 40. Also, the tapered members 47 and 48 are preferably self threading screws threadably engageable in the opening 49 defined by the curved surfaces 372 and 452 from the front and rear ends 42 and 44 of the magazine 40, thereby eliminating the requirement of performing a thread forming operation on the opposing front and rear ends 42 and 44 of the magazine.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A fastener driving tool having an actuatable tool controlling mechanism, the fastener driving tool comprising:

a nose-piece with a channel for guiding a fastener driven therefrom into a workpiece, the nose-piece having an end, a top side, an underside, and opposing sides;

a work contacting element having a top side with a recess, a bottom side, substantially opposing sides, and a tip, portions of the underside and portions of the opposing sides of the nose-piece disposed in the recess of the work contacting element to slidably retain the work contacting element to the nose-piece, the tip of the work contacting element biased to protrude forwardly beyond the end of the nose-piece;

the work contacting element coupled to the tool controlling mechanism, the work contacting element slidable back and forth along the underside of the nose-piece, parallel to the channel of the nose-piece, to actuate and de-actuate the tool controlling mechanism, whereby the location of the work contacting element along the underside of nose-piece provides for improved visibility of the nose-piece.

2. The fastener driving tool of claim 1, the opposing sides of the nose-piece extending divergently from the top-side of the nose-piece toward the underside of the nose-piece to form a substantially dove-tailed sectional shape, the recess in the work contacting element having a complementary substantially dove-tailed sectional shape to slidably retain the work contacting element to the nose-piece.

3. The fastener driving tool of claim 1, the work contacting element having an arm extending rearwardly away from the tip of the work contacting element and along one side of the nose-piece, the arm coupled to the tool controlling mechanism.

4. The fastener driving tool of claim 3, the work contacting element formed of a plastic.

5. The fastener driving tool of claim 4 further comprising a wire link having a threaded end portion protruding from the work contacting element, a portion of the wire link captured in the plastic portion of the work contacting element.

6. The fastener driving tool of claim 3 further comprising:

a link coupled to the arm of the work contacting element, the link having a threaded end portion extending rearwardly away from the tip of the work contacting element and along one side of the nose-piece;

a bracket coupled to the tool controlling mechanism, the bracket having two spaced apart fingers, each finger having a curved end portion forming a groove across the finger, the grooves across the fingers formed along a common axis, a portion of the link disposed in the grooves of the fingers;

an adjustment nut disposed about the threaded portion of the link between the fingers of the bracket;

a resilient ring disposed about the threaded portion of the link, the resilient ring disposed between the adjustment nut and one of the fingers, the resilient ring under compression, whereby the work contacting element is adjustable upon rotation of the adjustment nut, and the compressed resilient ring prevents unintentional adjustment of the work contacting element.

7. The fastener driving tool of claim 6 further comprising a washer disposed about the threaded portion of the link, the washer disposed between the resilient ring and one of the fingers.

8. A fastener driving tool having a work contacting element slidably coupled to a nose-piece, the work contacting element biased to protrude forwardly beyond an end of the nose-piece, and the work contacting element movable relative to the nose-piece to actuate a tool controlling mechanism for enabling and disabling the fastener driving tool, the fastener driving tool comprising:

a link coupled to the work contacting element, the link having a threaded end portion extending rearwardly away from the tip of the work contacting element and along one side of the nose-piece;

a bracket coupled to the tool controlling mechanism, the bracket having two spaced apart fingers, each finger having a curved end portion forming a groove across the finger, the grooves across the fingers formed along a common axis, a portion of the link disposed in the grooves of the fingers;

an adjustment nut disposed about the threaded portion of the link between the fingers of the bracket;

a resilient ring disposed about the threaded portion of the link, the resilient ring disposed between the adjustment nut and one of the fingers, the resilient ring under compression;

a washer disposed about the threaded portion of the link, the washer disposed between the resilient ring and one of the fingers, whereby the work contacting element is adjustable upon rotation of the adjustment nut, and the compressed resilient ring prevents unintentional adjustment of the work contacting element.

9. The fastener driving tool of claim 8 further comprising an adjustment limiting member protruding from the link, the adjustment limiting member disposed toward an end of the link outside the fingers of the bracket, whereby the adjustment limiting member limits adjustment of the work contacting element away from the nose-piece, thereby preventing separation of the work contacting element from the tool.

10. The fastener driving tool of claim 8, the adjustment nut having a knurled outer surface.

11. A fastener driving tool comprising:

a nose-piece having a backplate hingedly coupled to a frontplate, the backplate pivotable relative to the frontplate between opened configuration and a closed configuration;

the backplate and frontplate defining a channel therebetween for driving a fastener from an end of the nose-piece into a workpiece when the nose-piece is in the closed configuration, and exposing the channel when the nose-piece is in the opened configuration;

a first flange protruding from a side of the backplate substantially transverse to the channel, and a second flange protruding from the same side of the frontplate substantially transverse to the channel, the first flange and the second flange in substantially mating relationship when the backplate and the frontplate are in the closed configuration;

a lever disposed along the side of the nose-piece and movable back and forth relative to the nose-piece, the lever having a back end and an opposing front end disposed toward the end of the nose-piece, the front end having a recess for receiving the first flange and the second flange in substantially mating relationship;

a compressed spring member acting on the back end of the lever to bias the lever toward the end of the nose-piece where the first flange and the second flange are receivable in the recess of the lever and maintained in substantially mating relationship when the backplate and the frontplate are in the closed configuration, the lever movable rearwardly away from the end of the nose-piece against the bias of the compressed spring member to release the first flange and the second flange in substantially mating relationship from the recess of the lever, whereby the backplate is pivotable relative to frontplate to the opened configuration when the first flange and the second flange are released from the recess of the lever.

12. The fastener driving tool of claim 11, the lever movably coupled to the nose-piece, the lever having a front finger protruding from the front end of the lever and a back finger protruding from the back end of the lever, an end of the spring member disposed about the back finger, and the front finger disposed between opposing guide members on the nose-piece, whereby the lever is movable back and forth substantially parallel to the channel of the nose-piece.

13. The fastener driving tool of claim 11, the lever having a flange protruding laterally outwardly away from the lever for gripping the lever and moving the lever rearwardly away from the end of the nose-piece against the bias of the compressed spring member.

14. The fastener driving tool of claim 11, the first flange on the backplate having an inclined lower rearwardly located surface, and the lever having an inclined upper forwardly located surface, the inclined surface of the backplate engageable with the inclined surface of the lever when the backplate is moved from the opened configuration to the closed configuration to move the lever rearwardly away from the end of the nose-piece and to permit pivoting the backplate to the closed configuration.

15. An improved fastener driving tool having a nose-piece with a channel for sequentially receiving individual fasteners from a collated strip of fasteners and for guiding fasteners driven from an aperture of the nose-piece, the improvement comprising:

a magazine having a channel for receiving the collated strip of fasteners, the magazine having a front end coupled to the nose-piece for sequentially feeding individual fasteners from the channel of the magazine to the channel of the nose-piece, the magazine having a first elongated member with a first side wall having a first inner surface, a first front end, a first rear end, a first top edge portion, and a first bottom edge portion, the first bottom edge portion of the first elongated member having a recess formed by an outer flange and an inner flange, the recess extending along a length of the first elongated member;

the magazine having a second elongated member with a second side wall having a second inner surface, a second front end, a second rear end, a second top edge portion, and a second bottom edge portion, the second bottom edge portion of the second elongated member having an intermediate flange with an inner surface and an outer surface, the first top edge portion of the first elongated member matable with the second top edge portion of the second elongated member, and the intermediate flange of the second bottom edge portion disposeable in the recess formed by the inner flange and the outer flange of the first bottom edge portion, so that the first inner surface of the first side wall faces the second inner surface of the second side wall;

a tapered member disposeable between the inner surface of the intermediate flange and the inner flange at the front and rear ends of the magazine to urge the outer surface of the intermediate flange into engagement with the outer flange, whereby the first inner surface of the first side wall is accurately space relative to the second inner surface of the second side wall to form the channel therebetween in the magazine.

16. The fastener driving tool of claim 15, a portion of the recess formed on an inner surface of the outer flange having a curved surface, and the outer surface of the intermediate flange having a curved surface engageable with the curved inner surface of the outer flange by the urging of the tapered members.

17. The fastener driving tool of claim 15, a portion of the recess formed on an inner surface of the inner flange having a curved surface, and the inner surface of the intermediate flange having a curved surface, the curved surface of the inner flange facing the curved surface of the intermediate flange to form an opening therebetween extending the length of the magazine, the tapered members disposable into the opening.

18. The fastener driving tool of claim 17, the tapered members are self threading screws threadably engageable in the opening between the inner flange and the intermediate flange.

19.The fastener driving tool of claim 15, the first elongated member having the same cross-sectional configuration along an entire length of the first elongated member, and the second elongated member having the same cross-sectional configuration along an entire length of the second elongated member, whereby the first elongated member and the second elongated member are formable by extrusion.

20. The fastener driving tool of claim 15 further comprising a rear end plate disposeable on a rear end of the magazine formed by the first rear end of the first elongated member and the second rear end of the second elongated member.

* * * * *